US007357337B2

(12) United States Patent
Ferrari

(10) Patent No.: US 7,357,337 B2
(45) Date of Patent: Apr. 15, 2008

(54) FLOW REGULATOR

(75) Inventor: Maria Teresa Ferrari, Casaloldo (IT)

(73) Assignee: Dyapason S.R.L., Castel Goffredo (IT)

( * ) Notice: Subject to any disclaimer, the term of this patent is extended or adjusted under 35 U.S.C. 154(b) by 0 days.

(21) Appl. No.: 11/139,537

(22) Filed: May 31, 2005

(65) Prior Publication Data

US 2006/0011748 A1 Jan. 19, 2006

(30) Foreign Application Priority Data

Jul. 13, 2004 (IT) ..... MN2004A0015

(51) Int. Cl.
*E03C 1/08* (2006.01)
*B05B 1/14* (2006.01)
*B05B 1/00* (2006.01)

(52) U.S. Cl. ..... 239/428.5; 239/590.3; 239/590.5; 239/600

(58) Field of Classification Search ..... 239/428.5, 239/590.3, 590.5, 600, 427, 553, 553.3, 590
See application file for complete search history.

(56) References Cited

U.S. PATENT DOCUMENTS 2,747,930 A 5/1956 Hyde
2,998,929 A * 9/1961 Aghnides ..... 239/428.5
3,138,332 A * 6/1964 Gottlob ..... 239/427
3,554,451 A 1/1971 Aghnides
3,829,026 A * 8/1974 Aghnides ..... 239/394
4,470,546 A * 9/1984 Wildfang ..... 239/428.5
4,637,552 A * 1/1987 Finkbeiner et al. ..... 239/428.5
5,495,985 A * 3/1996 Nehm et al. ..... 239/428.5
6,152,182 A * 11/2000 Grether et al. ..... 138/42
6,513,731 B2 * 2/2003 Griffin et al. ..... 239/394
2004/0050968 A1 3/2004 Grether et al.
2005/0247805 A1 * 11/2005 Grether ..... 239/428.5

FOREIGN PATENT DOCUMENTS

DE 16 09 035 A1 4/1970
DE 10149335 * 4/2003
NL 6 403 892 A 10/1965

* cited by examiner

*Primary Examiner*—Darren Gorman
(74) *Attorney, Agent, or Firm*—Modiano & Associati; Albert Josif; Daniel J. O'Byrne

(57) ABSTRACT

A flow regulator, comprising an enclosure which in turn comprises at least one screen designed to be crossed by the stream and is provided, at the input section, with a small net and with an underlying jet breaker plate provided with holes adapted to break up the stream, the holes provided in the jet breaker plate being distributed along closed geometrical figures centered on the plate, a barrier provided with ridges located at the hales being provided directly below the plate.

18 Claims, 7 Drawing Sheets

Fig. 7
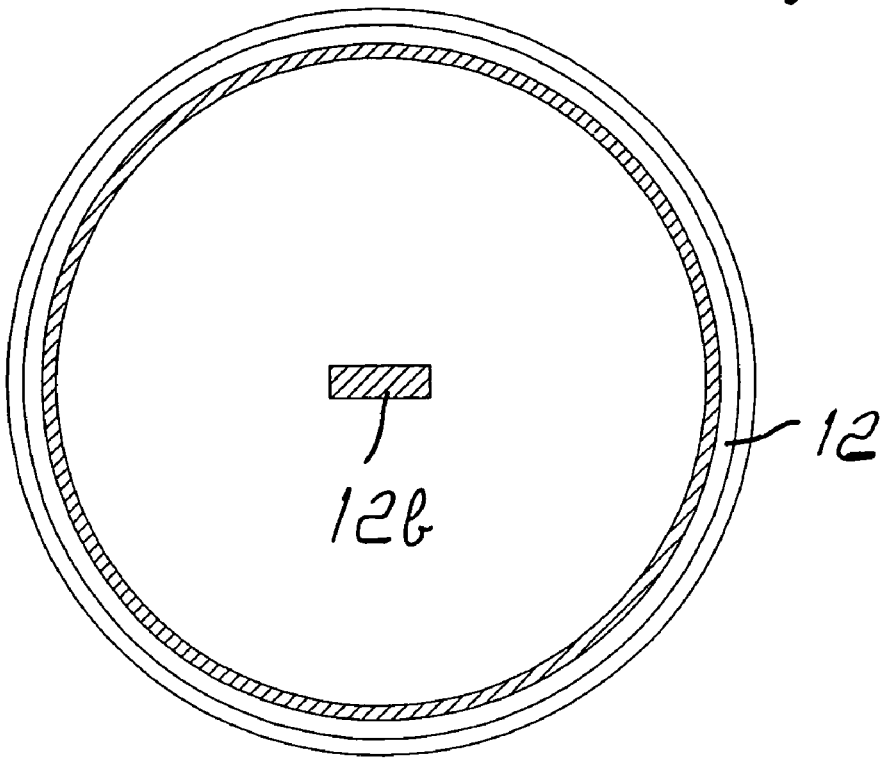
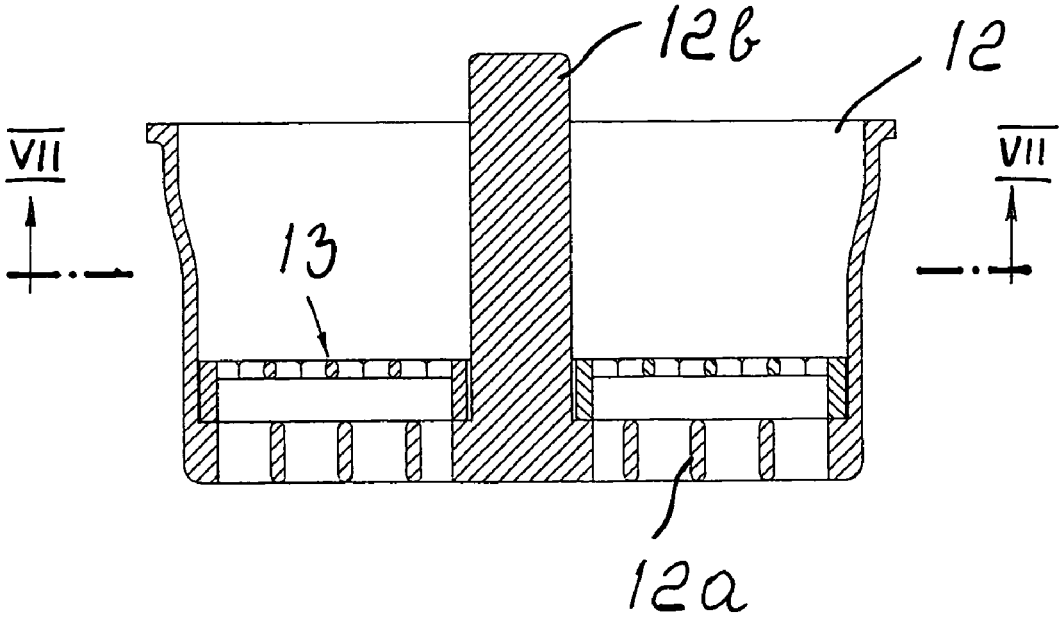
Fig. 6

FLOW REGULATOR

BACKGROUND OF THE INVENTION

It is known that there are devices known as flow regulators or aerators, which are designed to be inserted at the end section of ducts that convey water in output from faucets installed in sanitary fixtures or in kitchen sinks in order to provide a well-aerated cylindrical jet that does not spray.

These devices comprise an external enclosure, which is provided with ports for the passage of air that is meant to mix with the stream of water and comprises at least one screen that is crossed by such stream: at the input section, a wire mesh and an underlying jet breaker plate provided with holes adapted to break up the stream, are provided.

SUMMARY OF THE INVENTION

The aim of the present invention is to provide a flow regulator that has maximum functional efficiency.

The proposed aim is achieved by a flow regulator according to the invention, comprising an enclosure, which in turn comprises at least one screen designed to be crossed by the stream and is provided, at the input section, with a small net and with an underlying jet breaker plate provided with holes adapted to break up the stream, characterized in that the holes provided in the jet breaker plate are distributed along dosed geometrical figures centered on the plate, a barrier with ridges located at said holes being provided directly below said plate.

BRIEF DESCRIPTION OF THE DRAWINGS

Further characteristics and advantages will become better apparent from the description of preferred but not exclusive embodiments of the invention, illustrated by way of non-limiting examples in the accompanying drawings, wherein:

FIG. 6 is a sectional view of a detail of the invention according to a first variation;

FIG. 7 is a sectional view, taken along the line VII-VII of FIG. 6;

DESCRIPTION OF THE PREFERRED EMBODIMENTS

Figure 1:
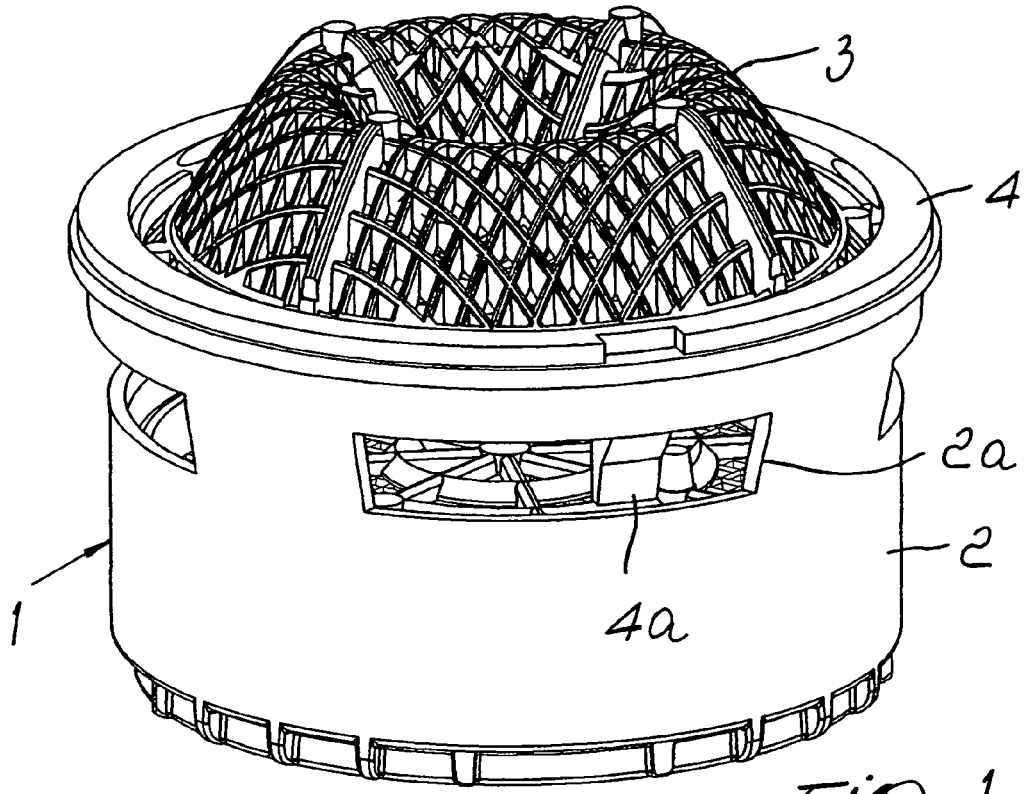
FIG. 1 is a perspective view of the invention.
Figure 2:
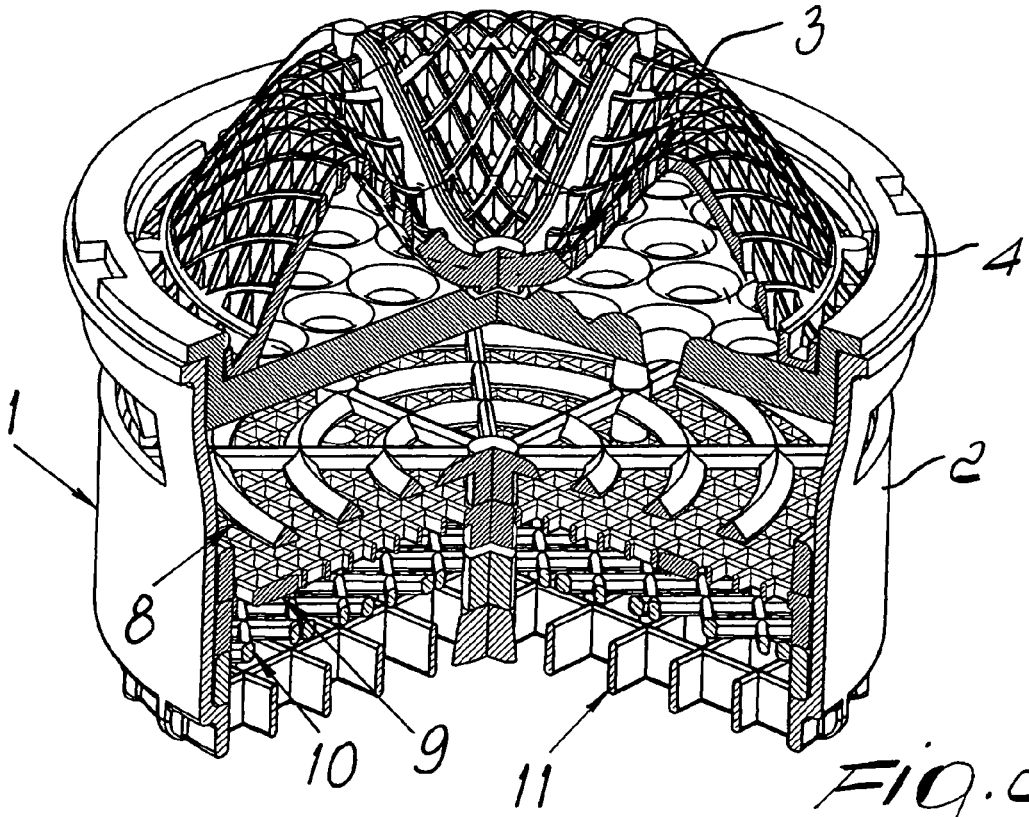
FIG. 2 is another view of the invention of FIG. 1, with a part removed for illustration purposes.
Figure 3:
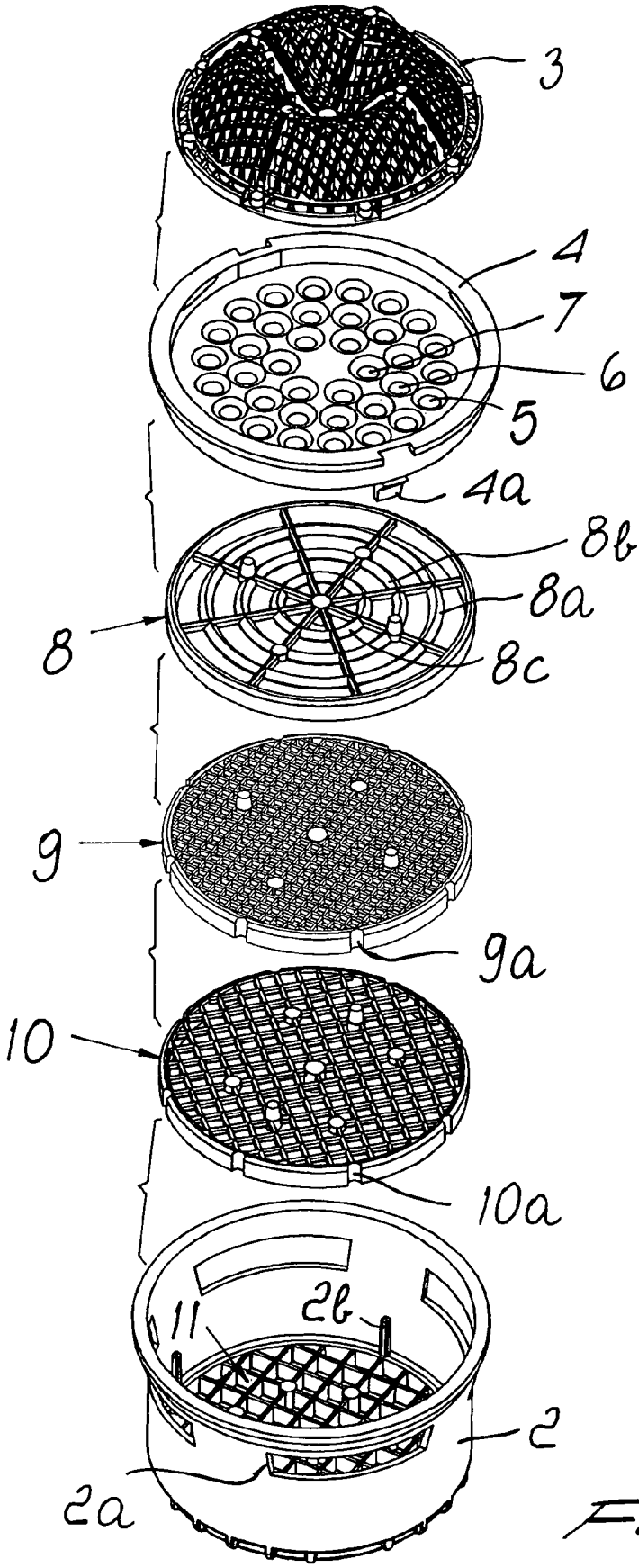
FIG. 3 is an exploded view of the invention.

With reference to FIGS. 1 to 5, the reference numeral 1 generally designates the flow regulator, which comprises the enclosure 2, which has, at the water input section, the small net 3, which is dome-shaped with a recess at its central region and is further provided with the jet breaker plate 4, which has holes adapted to break up the stream of incoming water and is fixed to the enclosure 2 by means of teeth 4*a*, which are designed to engage with a snap action the edge of the ports 2*a* provided in the wall of the enclosure 2 in order to allow the inflow of air that is meant to mix with the water.

Figure 4:
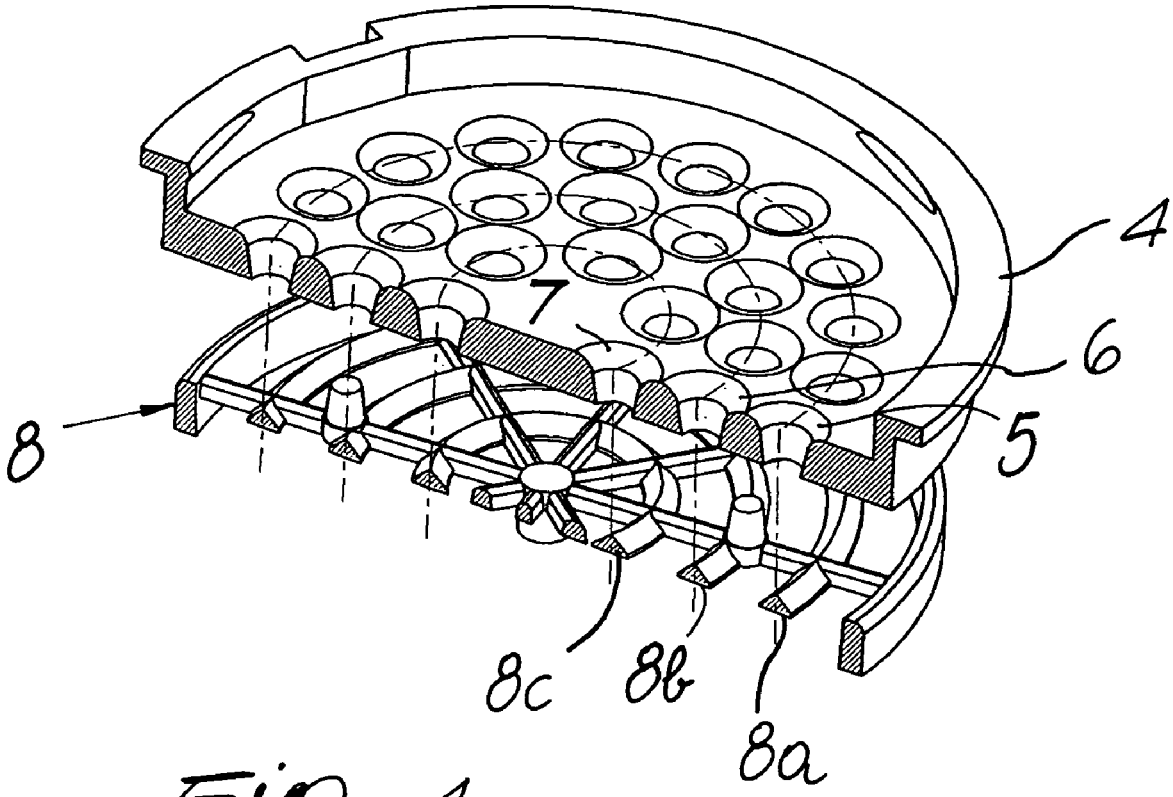
FIG. 4 is a view of a detail of the invention, with a part removed for illustration purposes.

The holes provided in the jet breaker plate 4 are distributed along concentric circles and therefore the holes 5 are distributed so that their centers lie within the external circumference, the holes 6 are distributed so that their centers lie within the intermediate circumference, and finally the holes 7 are distributed so that their centers lie within the internal circumference; all such three circumferences are shown by means of dot-and-dash lines in FIG. 4.

Directly below the plate 4 there is a barrier 8, which is detachably inserted within the enclosure 2 and is provided with concentric circular ridges located at the holes provided in the plate 4: in this way, the ridge 8*a* is arranged at the holes 5 on the external circumference, the ridge 8*b* is located at the holes 6 on the intermediate circumference, and finally the ridge 8*c* is located at the holes 7 on the internal circumference.

Figure 5:
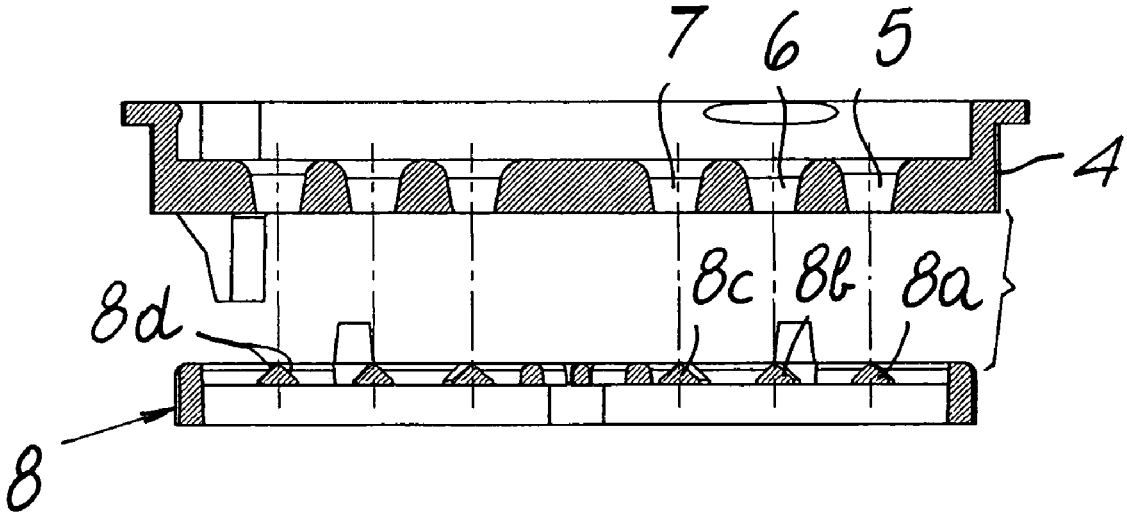
FIG. 5 is a view of the cross-section shown in FIG. 4.

This circumstance is clearly illustrated in FIGS. 4 and 5 by means of dot-and-dash lines.

Advantageously, an appropriate mutual sizing of the holes provided in the plate 4 and of the ridges in the barrier 8 causes the jets that exit from said holes to be affected by said ridges at at least 50% of the cross-section of said jets.

It should also be noted that the cross-section of the ridges of the disk 8 is shaped like a cusp directed toward the inlet of the stream, with planes 8*d* that converge at the vertex and are inclined by at least 30° with respect to the horizontal; the cusp might also be provided by means of arc-like surfaces.

Below the barrier 8 there are, in order to constitute additional screens designed to be crossed by the stream that passes through the device, the two barriers 9 and 10, provided with ridges that are adapted to form grids with square meshes of different sizes, which reach the external perimeter of said barriers; said barriers are detachably associated with the enclosure 2 by way of reference means for positioning them.

Such means comprise peripheral notches 9*a* and 10*a* respectively for the barrier 9 and for the barrier 10, which are adapted to be associated with ribs 2*b* provided at the wall of the enclosure 2.

Another screen 11, designed to be crossed by the water stream, is provided monolithically at the bottom of the enclosure 2 by means of ridges arranged so as to form a grid with square meshes, which extends along the entire extent of said bottom.

A variation of the means for reference in positioning the barriers detachably associated with the external enclosure is now described with reference to FIGS. 6 and 7.

In such figures, the reference numeral 12 designates the external enclosure provided at its bottom, which comprises ridges such as 12*a*, with the central stem 12*b*, which has a rectangular cross-section, and the reference numeral 13 designates a barrier that is inserted detachably in the enclosure 12 and is provided with a central port that is complementary with respect to the cross-section of the stem 12*b*, so as to force the positioning of said barrier with respect to said enclosure.

Figure 9:
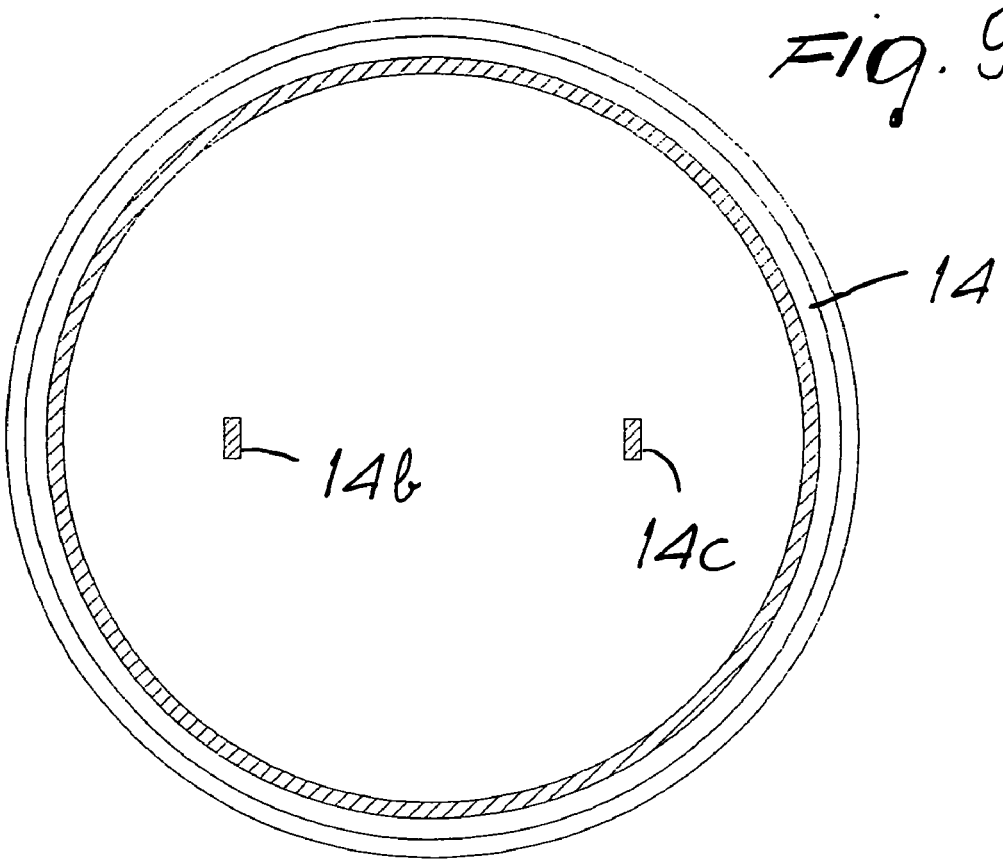
FIG. 9 is a sectional view, taken along the line IX-IX of FIG. 8.
Figure 8:
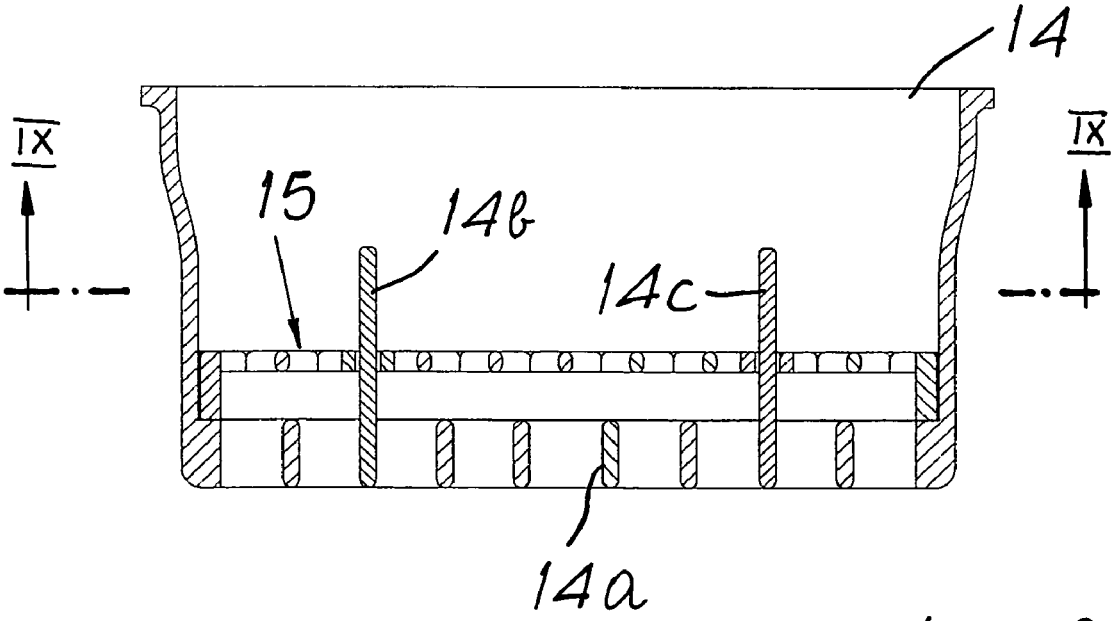
FIG. 8 is a sectional view of a detail of the invention according to a second embodiment.

FIGS. 8 and 9 illustrate another embodiment of the means for reference in positioning the barriers that are detachably associated with the external enclosure.

In such figures, the reference numeral 14 designates the external enclosure provided at its bottom, which comprises ridges 14*a*, with the two stems 14*b* and 14*c*, and the reference numeral 15 further designates a barrier that is inserted detachably in the enclosure 14 and is provided with ports that are complementary with respect to the cross-section of the stems 14*b* and 14*c*.

Figure 11:
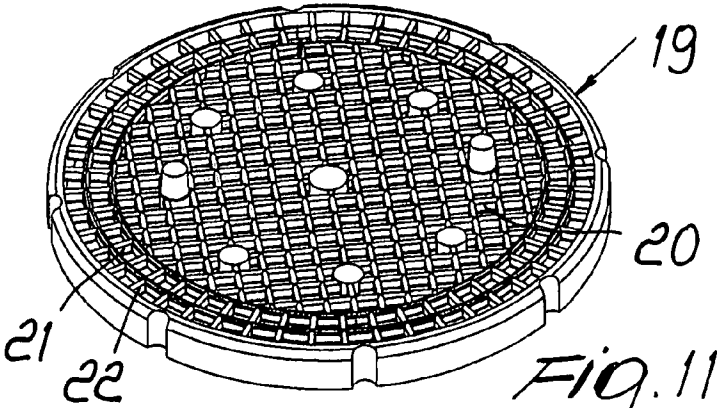
FIGS. 10 and 11 illustrate a barrier designed to be detachably associated with the external enclosure according to two embodiments.
Figure 10:
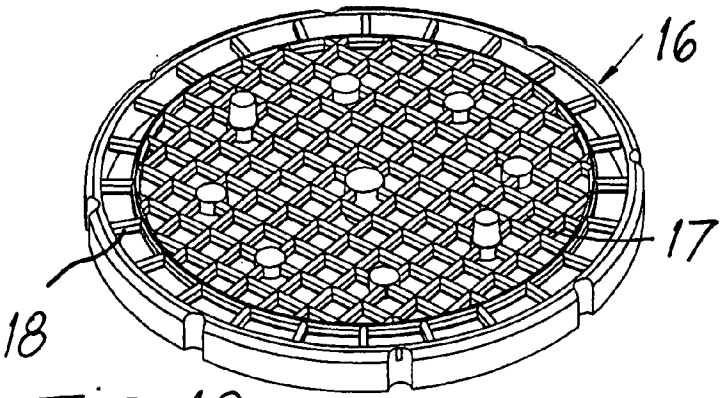

FIGS. 10 and 11 illustrate two barriers designed to be associated detachably with the external enclosure according to two embodiments: whereas in the barrier 16 of FIG. 10 there is the grid 17, delimited only by the peripheral ring 18 provided with radial ridges, in the barrier 19 of FIG. 11 the grid 20 is delimited by two circular rings provided with radial ridges 21 and 22.

Figure 13:
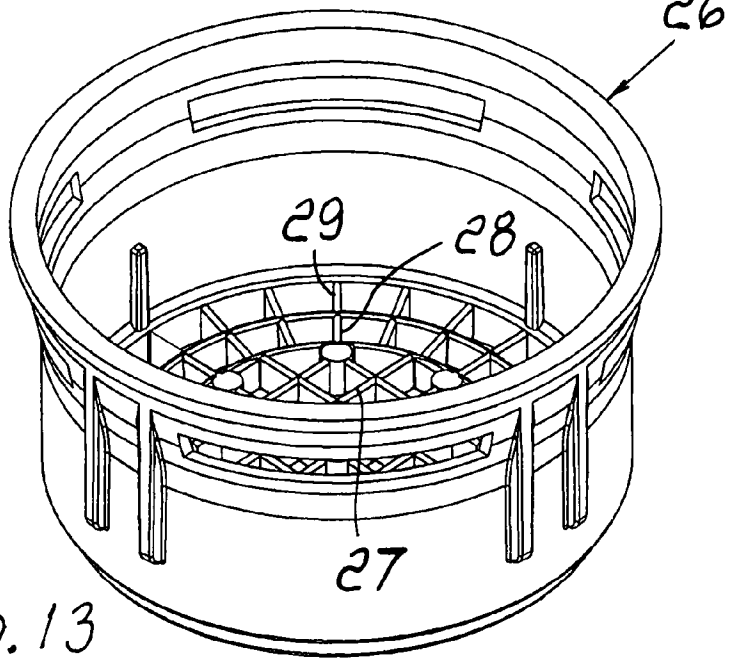
FIGS. 12 and 13 are views of two embodiments of the external enclosure.
Figure 12:
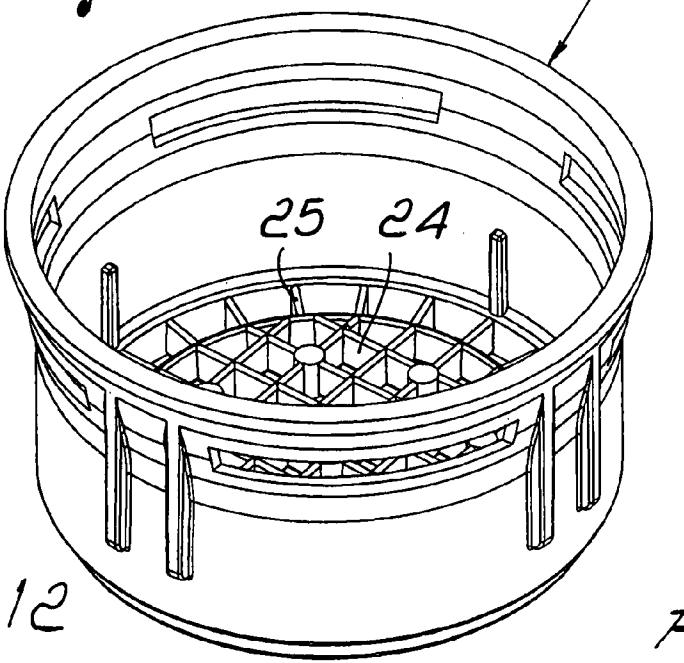

FIGS. 12 and 13 illustrate two embodiments of the external enclosure of the flow regulator: the enclosure 23 of FIG. 12 is provided with a bottom that comprises the grid 24 delimited by the peripheral ring with radial ridges 25, and the enclosure 26 of FIG. 13 is provided with a bottom that comprises the grid 27 delimited by the two peripheral rings with radial ridges 28 and 29.

Figure 14:
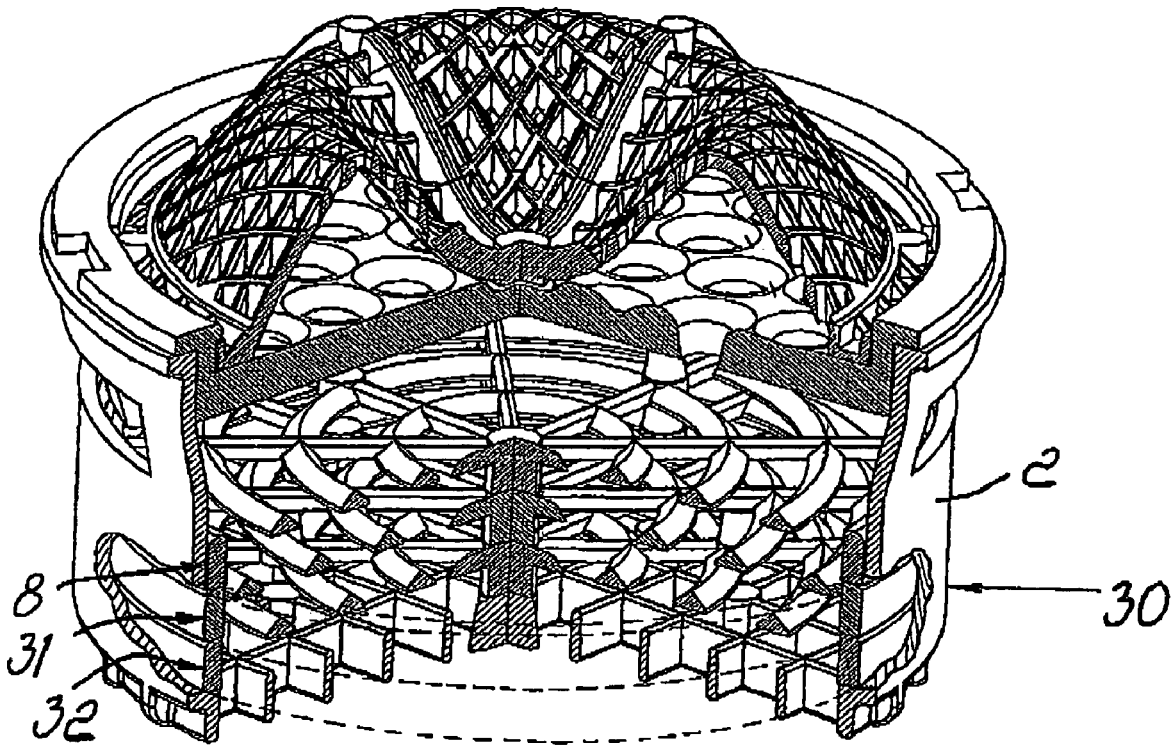
FIG. 14 is a view of another embodiment of the invention, with a part removed for illustration purposes.

An additional embodiment of the invention is shown in FIG. 14, which generally designates with the reference numeral 30 a flow regulator, which comprises, within the external enclosure 2, below the barrier 8 provided with concentric circular ridges, the two additional barriers 31 and 32, also provided with concentric circular ridges, and said ridges have such diameters that they are mutually offset, as clearly shown by said FIG. 14.

The described invention is susceptible of numerous modifications and variations in addition to those described, all of which are within the scope of the inventive concept: thus, for example, between the barrier arranged directly below the jet breaker plate and the bottom of the external enclosure it is possible to provide no further barriers or it is possible to detachably insert barriers that have no means for reference in positioning with respect to said enclosure.

Moreover, the holes that are provided in the jet breaker plate can be distributed along closed geometric figures of any kind that are centered on the plate, such as for example regular polygons, and directly below said plate there is always a barrier provided with ridges located at said holes.

The disclosures in Italian Patent Application no. MN2004A000015, from which this application claims priority, are incorporated herein by reference.

What is claimed is:

1. A flow regulator comprising an enclosure, which in turn comprises at least one screen designed to be crossed by a stream and is provided, at an input section, with a wire gauze and with an underlying jet breaker plate provided directly below the wire gauze and provided with holes adapted to break up the stream, wherein the holes provided in the jet breaker plate are distributed along concentric circles centered on the jet breaker plate, a barrier in the form of a disk provided with concentric ridges located at said holes being provided directly below said plate.

2. The flow regulator according to claim 1, wherein the ridges comprised in the barrier below the jet breaker plate affect the individual jets that exit from the holes of said plate at at least 50% of said jets.

3. The flow regulator according to claim 1, wherein the ridges comprised in the barrier located below the jet breaker plate have a cusp-shaped cross-section that is directed toward an inlet of the stream, with planes or arcs that converge at a vertex of the cusp and are inclined by at least 30° with respect to the horizontal.

4. The flow regulator according to claim 1, wherein there is at least one barrier associated detachably with the enclosure below the barrier located directly below the jet breaker plate.

5. The flow regulator according to claim 4, wherein the at least one barrier associated detachably with the enclosure comprises ridges that are adapted to form a grid and is provided with means for reference in positioning with respect to the enclosure.

6. The flow regulator according to claim 4, wherein the at least one barrier associated detachably with the enclosure comprises ridges that are adapted to form a grid and is provided with means for reference in positioning with respect to the enclosure that comprise at least one peripheral notch that is adapted to be associated with a rib provided at a wall of the enclosure.

7. The flow regulator according to claim 4, wherein the at least one barrier associated detachably with the enclosure comprises ridges that are adapted to form a grid and is provided with means for reference in positioning with respect to the enclosure that comprise a central stem, which has a cross-section provided with at least one face and protrudes from a bottom of the enclosure, said stem being designed to be associated with said barrier at a complementary port provided in said barrier.

8. The flow regulator according to claim 4, wherein the at least one barrier associated detachably with the enclosure comprises ridges that are adapted to form a grid and is provided with means for reference in positioning with respect to the enclosure that comprise at least one eccentric stem, which protrudes from a bottom of the enclosure and is designed to be associated with said screen at a complementary port provided in said barrier.

9. The flow regulator according to claim 4, wherein the at least one barrier associated detachably with the enclosure comprises ridges that are adapted to form a grid and has no means for reference in positioning with respect to the enclosure.

10. The flow regulator according to claim 4, wherein the at least one barrier associated detachably with the enclosure comprises ridges that are adapted to form a grid that reaches an external perimeter of said barrier.

11. The flow regulator according to claim 4, wherein the at least one barrier associated detachably with the enclosure comprises ridges that are adapted to form a grid that is delimited by at least one peripheral ring provided with radial ridges.

12. The flow regulator according to claim 1, wherein the enclosure has, at a bottom, a port for the passage of the stream provided with ridges that are adapted to form a grid with square meshes that reaches an external perimeter of said port.

13. The flow regulator according to claim 1, wherein the enclosure has, at a bottom, a port for the passage of the stream provided with ridges that are adapted to form a grid with square meshes that is delimite least one peripheral ring provided with radial ridges.

14. The flow regulator according to claim 1, wherein the wire gauze provided at the input section of the enclosure is dome-shaped, with a recess at a central region.

15. The flow regulator according to claim 1, wherein there are means for coupling the jet breaker plate to a wall of the enclosure that is provided with ports for the inflow of air that is meant to mix with the stream, said means comprising teeth that are adapted to be associated with a snap action by elastic deformation with the edge of said ports.

16. The flow regulator according to claim 1, wherein the enclosure has, at a bottom, a port for the passage of the stream that is provided with ridges that form a monolithic assembly with the cylindrical wall of said enclosure and are adapted to form a square-mesh grid.

17. The flow regulator according to claim 16, wherein the a square-mesh grid reaches the external perimeter of said port.

18. A flow regulator comprising an enclosure, which in turn comprises at least one screen designed to be crossed by a stream and is provided, at an input section, with a wire gauze and with an underlying jet breaker plate provided with holes adapted to break up the stream, wherein the holes provided in the jet breaker plate are distributed along closed geometrical figures centered on the jet breaker plate, a barrier with ridges located at said holes being provided directly below said plate and wherein there are means for coupling the jet breaker plate to a wall of the enclosure that is provided with ports for the inflow of air that is meant to mix with the stream, said means comprising teeth that are adapted to be associated with a snap action by elastic deformation with the edge of said ports.

* * * * *

US007357337C1

(12) EX PARTE REEXAMINATION CERTIFICATE (7709th)

United States Patent
Ferrari

(10) Number: US 7,357,337 C1
(45) Certificate Issued: Aug. 31, 2010

(54) FLOW REGULATOR

(75) Inventor: Maria Teresa Ferrari, Casaloldo (IT)

(73) Assignee: Dyapason S.R.L., Castel Goffredo (IT)

Reexamination Request:
No. 90/009,551, Aug. 4, 2009

Reexamination Certificate for:

| | |
|---|---|
| Patent No.: | **7,357,337** |
| Issued: | **Apr. 15, 2008** |
| Appl. No.: | **11/139,537** |
| Filed: | **May 31, 2005** |

(51) Int. Cl.

| | |
|---|---|
| ***E03C 1/08*** | (2006.01) |
| ***B05B 1/14*** | (2006.01) |
| ***B05B 1/00*** | (2006.01) |

(52) U.S. Cl. ..... 239/428.5; 239/590.3; 239/590.5; 239/600

(58) Field of Classification Search ..... 239/428.5
See application file for complete search history.

(56) References Cited

U.S. PATENT DOCUMENTS

| | | | | |
|---|---|---|---|---|
| RE25,447 | E | * | 9/1963 | Hjulian ..... 239/428.5 |
| 4,470,546 | A | | 9/1984 | Wildfang |
| 6,152,182 | A | | 11/2000 | Grether et al. |
| 6,708,902 | B2 | | 3/2004 | Takeshi et al. |
| 2004/0050968 | A1 | | 3/2004 | Grether et al. |
| 2005/0247805 | A1 | | 11/2005 | Grether |

FOREIGN PATENT DOCUMENTS

| | | |
|---|---|---|
| DE | 10223789 | 12/2003 |

* cited by examiner

*Primary Examiner*—Aaron J. Lewis

(57) ABSTRACT

A flow regulator, comprising an enclosure which in turn comprises at least one screen designed to be crossed by the stream and is provided, at the input section, with a small net and with an underlying jet breaker plate provided with holes adapted to break up the stream, the holes provided in the jet breaker plate being distributed along closed geometrical figures centered on the plate, a barrier provided with ridges located at the hales being provided directly below the plate.

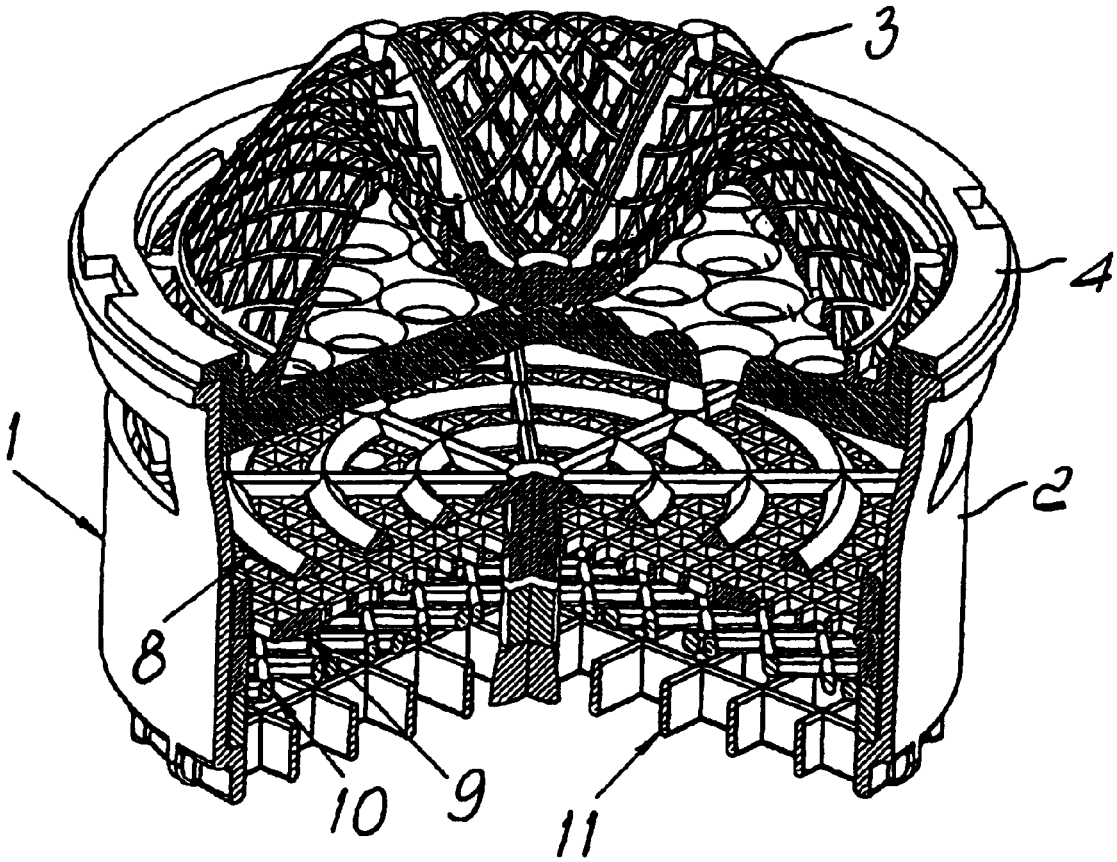

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 15 and 18 is confirmed.

Claims 1-14 and 16-17 are cancelled.

* * * * *